US011772753B2

(12) United States Patent
Dakhil

(10) Patent No.: US 11,772,753 B2
(45) Date of Patent: Oct. 3, 2023

(54) AUTONOMOUS PLASTIC COLLECTING ROBOT

(71) Applicant: Farouk Dakhil, Rome (IT)

(72) Inventor: Farouk Dakhil, Rome (IT)

( * ) Notice: Subject to any disclaimer, the term of this patent is extended or adjusted under 35 U.S.C. 154(b) by 276 days.

(21) Appl. No.: 17/386,668

(22) Filed: Jul. 28, 2021

(65) Prior Publication Data

US 2022/0055720 A1 Feb. 24, 2022

Related U.S. Application Data

(60) Provisional application No. 63/066,847, filed on Aug. 18, 2020.

(51) Int. Cl.

| | |
|---|---|
| ***B63B 35/32*** | (2006.01) |
| ***B63B 5/24*** | (2006.01) |
| ***B63H 21/17*** | (2006.01) |

(52) U.S. Cl.

CPC ..... *B63B 35/32* (2013.01); *B63B 5/24* (2013.01); *B63H 21/17* (2013.01); *B63B 2005/242* (2013.01); *B63B 2209/18* (2013.01); *B63B 2213/02* (2013.01); *B63B 2231/52* (2013.01); *B63H 2021/171* (2013.01)

(58) Field of Classification Search

CPC . B63B 35/32; B63B 2209/18; B63B 2213/02; B63B 2035/007; B63H 21/17; B63H 1/36

See application file for complete search history.

(56) References Cited

U.S. PATENT DOCUMENTS

| | | | |
|---|---|---|---|
| 4,467,659 | A | 8/1984 | Baumoel |
| 4,963,596 | A | 10/1990 | Lindert et al. |
| 5,298,289 | A | 3/1994 | Lindert et al. |
| 6,194,357 | B1 | 2/2001 | Murata et al. |
| 6,361,623 | B1 | 3/2002 | Ishikura et al. |
| 6,455,476 | B1 | 9/2002 | Imai et al. |

(Continued)

FOREIGN PATENT DOCUMENTS

| | | | | |
|---|---|---|---|---|
| CN | 106347591 A | * | 1/2017 | |
| CN | 113277052 A | * | 8/2021 | ..... B63B 35/32 |
| JP | 2000-309793 A | | 11/2000 | |

OTHER PUBLICATIONS

Purdue University, "Artificial intelligence is energy-hungry—new hardware could curb its appetite"; TechXplore; May 7, 2020; 3 pages.

(Continued)

*Primary Examiner* — Andrew Polay

(74) *Attorney, Agent, or Firm* — Maier & Maier, PLLC

(57) ABSTRACT

A method, system, and apparatus for collecting waste. In one embodiment, an autonomous plastic collecting robot (APCR) device for collecting waste may include a net structure that picks up micro plastic particles dispersed in water; a tube that transports the micro plastics collected by the net structure into a main internal container; an artificial tongue for collecting larger plastics, the artificial tongue comprised of a rolling staircase with fork-like structures in placed of the stairs; a plastic degrading medium contained in the main internal container; a no-joint tail structure which acts as the primary power source for the APCR, the no-joint tail structure housing dielectric elastomer materials and a rotation shaft located between at least two electric generators.

9 Claims, 11 Drawing Sheets

(56) References Cited

U.S. PATENT DOCUMENTS

| | | | | |
|---|---|---|---|---|
| 2005/0257848 | A1 | 11/2005 | Funatsu et al. | |
| 2013/0118885 | A1 | 5/2013 | Sarker | |
| 2015/0034565 | A1* | 2/2015 | Vaz Viegas | B63B 35/32 210/241 |
| 2015/0214862 | A1* | 7/2015 | Dakhil | F03B 13/20 416/146 R |
| 2016/0010300 | A1* | 1/2016 | Pizzi | E02B 15/104 210/396 |
| 2021/0214055 | A1* | 7/2021 | Maydanik | B07B 1/005 |
| 2022/0126955 | A1* | 4/2022 | Pleasant | B09B 3/60 |
| 2023/0067954 | A1* | 3/2023 | Marshall | E02B 15/047 |
| 2023/0202623 | A1* | 6/2023 | Hyde | B60L 53/12 114/256 |

OTHER PUBLICATIONS

Shosuke Yoshida et al., "A bacterium that degrades and assimilates poly(ethylene terephthalate)"; Science, Research | Reports; vol. 351 Issue 6278, Mar. 11, 2016, 4 pages.
University of Georgia, "8.3 billion metric tons: Scientists calculate total amount of plastics ever produced", Phys Org; Jul. 19, 2017; 3 pages.
Michelle MA, "Researchers find more efficient way to make oil from dead trees"; Phys Org; May 2, 2017; 3 pages.
Uwe T. Bornscheuer, "Feeding on plastic A bacterium completely degrades poly(ethylene terephthalate)"; Science; vol. 351 Issue 6278; Mar. 11, 2016; 2 pages.
Mingsong Jiang et al., "Flexoskeleton Printing Enables Versatile Fabrication of Hybrid Soft and Rigid Robots"; Soft Robotics; vol. 00, No. 00, 2020; 9 pages.
NYU Tandon School of Engineering; APA citation; "Open-source, low-cost, quadruped robot makes sophisticated robotics available to all"; TechXplore; Jun. 16, 2020 retrieved Jun. 22, 2020 from https://techxplore.com/news/2020-06-open-source-low-costquadruped- robot-sophisticated.html 3 pages.
Ian A. Kane et al., "Seafloor microplastic hotspots controlled by deep-sea circulation"; Science; 10.1126/science. aba5899; 2020; 11 pages Downloaded from http://science.sciencemag.org/ on May 6, 2020.
Jesse Jenkins, "New study shows microplastics turn into 'hubs' for pathogens, antibiotic-resistant bacteria"; Phys Org; Mar. 19, 2021; 3 pages.
N. Evangeliou et al., "Atmospheric transport is a major pathway of microplastics to remote regions"; Nature Communications; (2020) 11:3381 | https://doi.org/10.1038/s41467-020-17201-9 | www.nature.com/naturecommunications 11 pages.
XiaoZhi Lim, "Microplastics Are Everywhere—But Are They Harmful?"; Nature; vol. 593; May 6, 2021 22 pages.
L. Lebreton et al., "Evidence that the Great Pacific Garbage Patch is rapidly accumulating plastic"; Scientific Reports; (2018) 8:4666 | DOI:10.1038/s41598-018-22939-w 15 pages.
Xiangqing Jia et al., "Efficient and selective degradation of polyethylenes into liquid fuels and waxes under mild conditions"; Sci. Adv. 2016; 2: e1501591; Jun. 17, 2016 8 pages.
Bob Yirka, "The 1,000 rivers contributing the most to ocean plastics"; Phys Org; May 17, 2021; 2 pages.
Sangyul Baik et al., "A wet-tolerant adhesive patch inspired by protuberances in suction cups of octopi"; Nature; vol. 546; Jun. 15, 2017; 9 pages.
Nina Larson, "Tiny plastic particles from clothing, tyres clogging oceans: report"; Phys Org; Feb. 22, 2017; 2 pages.
Mohammad Vatankhah-Varnoosfaderani et al., "Bottlebrush Elastomers: A New Platform for Freestanding Electroactuation"; Advanced Materials; Apr. 29, 2016; 7 pages.
Dung Ngoc Pham et al., "Microplastics as hubs enriching antibiotic-resistant bacteria and pathogens in municipal activated sludge"; Journal of Hazardous Materials Letters; 2 (2021) 100014; Jan. 15, 2021; 7 pages.
Ping Hu et al., "Simulation of Deepwater Horizon oil plume reveals substrate specialization within a complex community of hydrocarbon degraders"; PNAS Early Edition; www.pnas.org/cgi/doi/10.1073/pnas.1703424114 6 pages.
Andrés Cózar et al., "The Arctic Ocean as a dead end for floating plastics in the North Atlantic branch of the Thermohaline Circulation"; Science Advances | Research Article; 2017;3: e1600582; Apr. 19, 2017 9 pages.
Motomichi Koyama et al., "Bone-like crack resistance in hierarchical metastable nanolaminate steels"; Science 355, 1055-1057; Mar. 10, 2017; 4 pages.
Daniel Cressey, "The Plastic Ocean Scientists Know That There is a Colossal Amount of Plastic in the Oceans. But They Don't Know Where It All Is, What It Looks Like or What Damage It Does."; Nature; vol. 536; Aug. 18, 2016; 3 pages.

* cited by examiner

AUTONOMOUS PLASTIC COLLECTING ROBOT

FIELD

Embodiments relate to autonomous waste collection devices, such as devices that can remove waste from bodies of water.

BACKGROUND

There are more than 300 million metric tons of plastics produced by the world's population most of which are collected and accumulate in landfills. Of the rest, some ends up in rivers, ports, seas, and oceans causing a natural disaster by polluting the water, killing or suffocating fish and birds, and most importunately creating micro plastics that destroy the natural habitat of phytoplankton, the basis of all nutrition in the seas and oceans. Micro plastics are even contributing to the build up of poisonous algae as lately observed in the Arabian sea and Indian Oceans. Plastics are made mainly of polyethylene which are undegradable in nature for hundreds of years, long enough to cause huge pollution and damage to the environment for the at least 200 years it takes to be decomposed. Moreover, even tap water, as has been lately discovered, can contain micro plastics particles (see https://phys.org/news/2017-09-plastic.html). 39.5% of micro plastics in oceans and seas were found coming from tires see: https://doi.org/10.1038/s41467-020-17201-9 | www.nature-.com/naturecommunications According to a new study published in Science magazine (doi: 10.1126/science.aao6749), there are more than 8 million tons of plastics entering the oceans every year. Globally plastic production per year is around 300 million tons. (see maps of plastic distribution around the globe. "From Arctic to Antarctic, from surface to sediment, in every marine environment where scientists have looked, they have found plastic. Other human-generated debris rots or rusts away, but plastics can persist for years, killing animals, polluting the environment, and blighting coastlines. By some estimates, plastics comprise 50-80% of the litter in the oceans." in this study below, in Nature (vol 536, 18 Aug. 2016 pages 263-265) "The Plastic Ocean": references)

Microplastic particles washed off products like synthetic clothing and car tires account for up to a third of the plastic polluting oceans, impacting eco-systems and human health. Because micro plastic particles are invisible to the naked eye and are sometimes overshadowed by images of country-sized plastic bags floating in the oceans, the microplastic particles that wash off textiles and roadways are hidden from sight. Microplastic particles constitute a significant part of the "plastic soup" clogging communities water accounting for between 15 and 31 percent of the estimated plastic released into the oceans each year, according to the International Union for Conservation of Nature (IUCN). See https://phys.org/news/2017-02-tiny-plastic-particles-tyres-clogging.html#nRlv Worst still micro plastic particles are also end up as food for both fish and birds, which then ends up in our food on our plates (see also latest nature publication 22 | Nature | Vol 593 | 6 May 2021)

Plastics have reached even the northern Arctic sea where they dead end and have been overserved to cause huge plastic accumulation in the northern and eastern areas of Greenland and Barents sea (see Sci. Adv. 3.e 1600582 (2017).

Ocean plastic is an indiscriminate hazard. It harms fish and kills seabirds, infecting the animals and causing severe inflammation in their digestive organs. Turtles swallow it because they mistake the floating waste for jellyfish. See how great this problem really is in nature scientific report: https://www.nature.com/articles/s41598-018-22939-w Less well-known are the ways plastic damages the ocean's smaller inhabitants, plankton and corals, which sometimes are found with particles wedged in their teeny guts. Indeed, lately scientists have found that antibiotic resistant microbes do attach to micro plastic and other pathogens. (see https://www.sciencedirect.com/science/article/pii/S2666911021000022?via%3Dihub)

SUMMARY

A method, system, and apparatus for collecting waste. In one embodiment, an autonomous plastic collecting robot (APCR) device for collecting waste may include a net structure that picks up micro plastic particles dispersed in water; a tube that transports the micro plastics collected by the net structure into a main internal container; an artificial tongue for collecting larger plastics, the artificial tongue comprised of a rolling staircase with fork-like structures in placed of the stairs; a plastic degrading medium contained in the main internal container; a no-joint tail structure which acts as the primary power source for the APCR, the no-joint tail structure housing dielectric elastomer materials and a rotation shaft located between at least two electric generators.

BRIEF DESCRIPTION OF THE FIGURES

Advantages of embodiments of the present invention will be apparent from the following detailed description of the exemplary embodiments. The following detailed description should be considered in conjunction with the accompanying figures in which:

Exemplary

Exemplary

Exemplary

Exemplary

Exemplary

Exemplary FIG. 3B shows the APCR in 3D with the solar disk in a lotus from.

Exemplary

Exemplary

Exemplary

Exemplary

Exemplary

DETAILED DESCRIPTION OF THE EMBODIMENTS

Figure 1A:
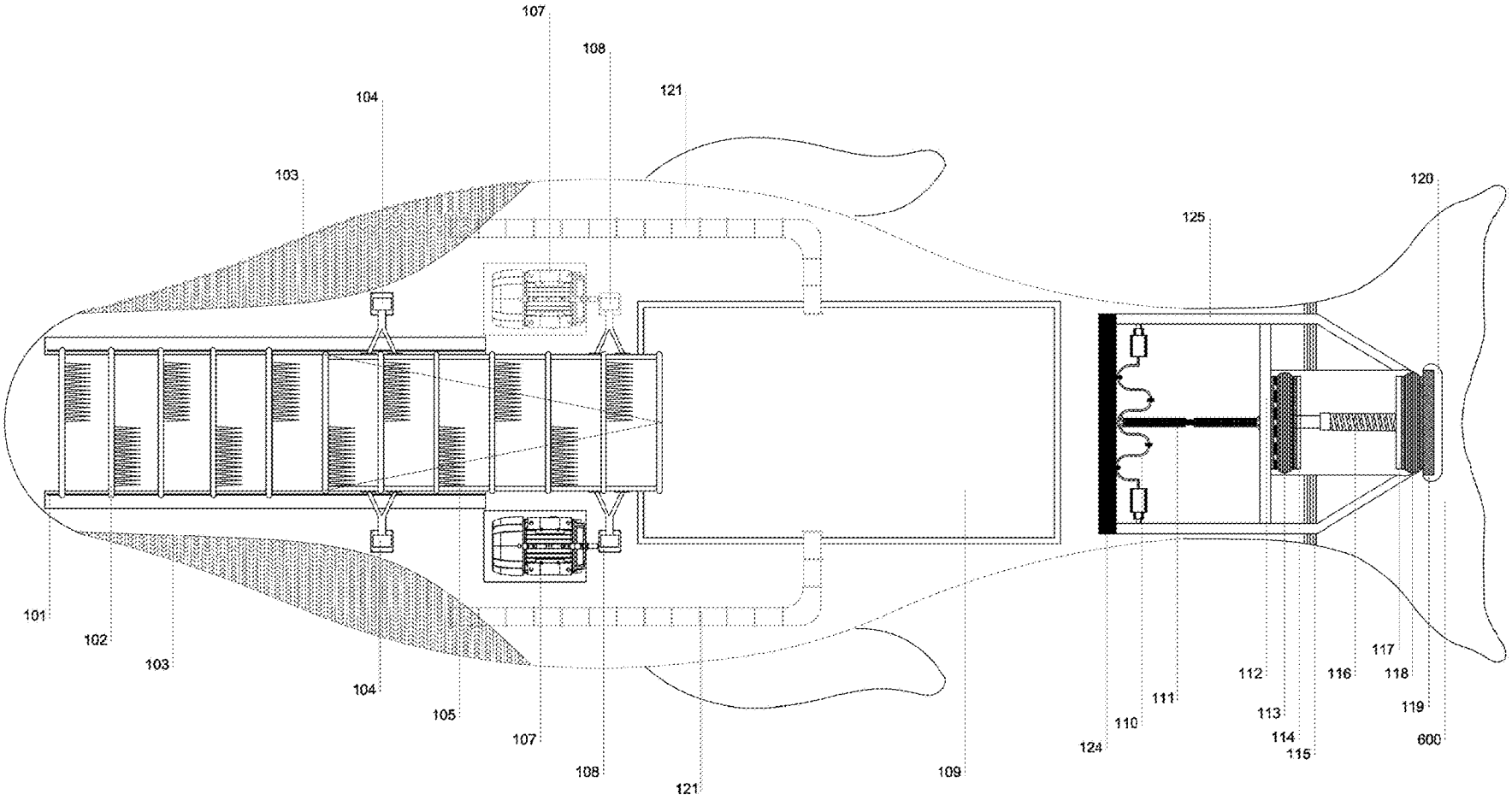
FIG. 1A shows a detailed arrangement of a first embodiment of the Autonomous Plastic Collecting Robot (APCR).

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, an autonomous plastics collecting robot (APCR) may be disclosed. Macro plastics and micro/nano-particles collected by the APCR may be separated in such a way that the macro plastics are taken out of the main container inside the "belly" of APCR and processed outside. The plastics may be processed inside a special pyrolysis reactor leaving only the micro and nano plastic particles inside the container to be digested by plastic digesting bacteria (PDB). This solution may be ideal for the application of the APCR in ports and city rivers where there can be difficulty unloading the container, leaving the APCR at all times ready to collect more of the micro and nano plastic particles. Collected plastic is then placed in the reactor and brought to a temperature of 300-400° C. to generate hydrocarbon vapor, which may also be converted to hydrocarbon liquid fuel via distillation process, in which the plastic waste is heated to generate a stream of hydrocarbon vapor that is then distilled and passed through a cooling retort for condensation, thus being converted by cooling the vapor stream into hydrocarbon liquid. Alternatively said waste plastics may be converted directly into liquid fuel using Acid-Catalyzed Cracking of liquefied plastics in forms like polyoelifins.

In addition, alternatively, the residual material of the heated plastics inside the pyrolysis chamber is rich in carbon-atoms so-called Plastics Carbonization. Steel is an alloy of iron and carbon and other minerals like magnesium Nickel and tungsten. As the residual plastic materials in said pyrolysis chamber are rich in carbon atoms, plastics residuals may then be processed in a smelting vessel to produce steel. Thus, the collected macro-plastics can be converted into bone-like structured steel through a simple chemical process similar to the actual processing of iron metal into steel, while here instead of combusting iron with coal at very high temperature of 1450° C., the macro-plastic is first turned to hydrocarbon or carbonized inside a pyrolysis reactor device to which iron is then added to said carbonized plastics, converting iron into steel as the atoms of iron has a structure full of vacancies and free surfaces that the carbon atoms in the now converted hydrocarbon occupy, these vacancies and free surfaces of the iron atomic structure, a chemical reaction that also takes place inside these high temperature furnaces in which is converted from iron raw material. Thereafter, converting the plastic/iron composite into steel 10 times even stronger actually than conventional steel as it's structure is bone-like which makes it more resilient and stronger (see: science DOI: 10.1126/science.aal2766). Additionally, iron usually oxidizes because these vacancies and free surfaces inside its atomic structure are occupied by oxygen atoms over time as oxygen reacts with the iron atoms. However, when carbon is added under high temperature carbon atoms fill these vacancies and thus create a steel structure that is stronger and more resilient to oxidization.

Thereafter, the plastic/iron composite is converted into steel 10 times stronger than conventional steel, as its structure is bone-like which makes it more resilient and stronger (see: science DOI: 10.1126/science.aal2766). Iron usually oxidizes, because these vacancies and free surfaces inside its atomic structure would be occupied with oxygen atoms over time, and the oxygen would react with the iron atoms. However, when carbon is added under high temperature carbon atoms would fill these vacancies and thus create a steel structure that is stronger and more resilient.

Therefore, the collected macro-plastics by the APCR is converted into useful materials, namely hydrocarbon fuel and resilient steel, while the micro-and-nano-plastic-particles are digested/eliminated by the bacteria species.

The collected macro-plastics may also be ground to granules and then recycled as used plastics, maybe of less quality but useful for example in car industry or other rather heavy industries, as many large industries are propagating. However, such recycling procedure needs a lot of energy and in order to obtain usable plastic material for further utilization the material need other additives and materials to be added.

Plastics: The vast majority of these plastic polymers are formed from chains of carbon atoms as in:

Polyethylene terephthalate (PET or PETE) High-density polyethylene (HDPE) Polyvinyl chloride (PVC) Low-density polyethylene (LDPE) Polypropylene (PP) Polystyrene (PS)

2. the APCR may also have a small testing device to measure acidity pH value of the seawater and its temperature may also have a sonar to inspect the bottom floor surface structure, whether there is any methane leakage, or detect any seismic activity and may immediately send over the GPs antenna to land base station where this data may be analyzed and registered for further investigation or analysis if needed.

While most of the present solutions are based upon a passive collection of plastics in areas of the oceans where there are high concentrations of plastics, the whale shark inspired autonomous robot is indeed an active even searching machine with GPS guided by an AI algorithm, for example deep learning, which may be like, for example, the "Deep Dream" software with which extract images of the objects in front of the APCR which are directly, on site, analyzed, recognized and the data is transmitted to a center of control if not for digestion is immediately avoided or blocked form rotating its artificial tongue to collect plastics, and only plastics, avoiding any other objects which are not plastics or micro plastics such as humans and ships. In case of a swarm of APCRs, the swarm may be programmed in such a way that the group coordinate and cooperate with one another like a team of an efficient school of living self-organized assembly.

Additionally, a mobile scientific mini laboratory may be carried inside the APCR (not shown) in which different analysis may take place like the measurement of the acidity (pH value) of the present situation in the ocean, the state of the phytoplankton in the area where plastics are collected, the amount of iron molecules in the ocean, or any other data that then can be directly transmitted via the GPS satellite to a control center on shore for further analysis and evaluation.

Furthermore, new species of bacteria were lately discovered that can digest this type of plastic of polyethylene and thus degrade this pollutant forever by digestion within a short period of time. Indeed, also a so-called wax worm was discovered by coincident in Spain (see Federica Bertoccini et. al in Current Biology, 2017, and Scientific American August, 2017). 100 of these wax worms thrown on plastic bags may digest 3% of the polyethylene within 12 hours. 92 mg. of plastic may be consumed in hours rather than years. Thus, a fast biodegradation of PE by larvae of the wax moth *Galleria mellonella*, producing ethylene glycol may be incorporated in the embodiments.

In an exemplary embodiment the plastic digesting bacteria ((see: Feeding on plastic, Science (2016). DOI: 10.1126/science.aaf2853) may then be collected and brought to shore. This may also be applied in the open oceans, where the wax worms may be added to collected plastics bags in replaceable containers in the robotic boat. In another embodiment a plastic degrading enzyme or compound may be used instead of bacteria or wax worms.

In an exemplary embodiment of the APCR a specialized species of PDB may be included. Also, this PDB may proliferate and grow in number and may spill over from within filled up collecting container 106 which would allow the PBD to descend to very deep level, between 0.6 and 6 km, to the ocean floor where the most dangerous part of this polluting material micro plastic particles are found in order to eliminate maximum amount of the microplastics particles. According to a new study done by the Lawrence Berkeley National Laboratory in 2017 (see PNAS doi: org/b842 (2017) oil digesting bacteria species were found able to feed on the 650 million tons of spelled oil during 2010 Deepwater Horizon disaster in the Gulf of Mexico. These bacteria species were able to digest and degrade all hydrocarbons and break them down at even a depth of 1,200 meters.

Additionally, the two eyes digital cameras do not only give the APCR direction in the 3 dimensional world, but are also equipped with a plastic recognition algorithm-software with which the robotic arm-machine can avoid any large objects and or collision with other sea vehicles like ships or boats and at same time reject any other type of materials in the sea/ocean, other than plastics, such as wood, organic material like fish etc. . . . . In ports and inside cities the software-algorithm may allow all sorts of garbage to be collected and then deposed, for example in some kind of power generation plant for ecological recycling.

plastic collecting robots in the prior art are mainly passive collecting conveyers in which some kind of a serpent-like floating round tube surrounds some location in the ocean where plastic particles are estimated to be located. In the present embodiments the search and selective localization of plastic particles is actively and systematically achieved by a well designed and controlled APCR.

Thereafter, the main advantages of the inventions compared with known technology solutions are as follows:

The autonomous robot is an active collecting apparatus of plastics in the sea and in ports.

The robot can move, directed to any location on seas and oceans and be located by GPS.

The robot can digest and eliminate the collected plastics on board/site.

The robot can also eliminate micro-plastics on the sea floor.

The robot can produce all of its needed energy on board through both solar and wave energy.

The robot can convert macro-plastics into useful products.

An exemplary embodiment of the APCR is shaped like a shark whale, which has a horizontal whale tail structure that allows for better and more efficient harnessing of the ocean's wave power.

The whale tail has No joints or multi-junction parts and functions as the main source of power supply for the APCR. A "No-Joints" or "All-in-One Piece", Concept is herein introduced within the whale robotic tail embodiment. This solution has an advantage in comparison with a hinge parts that create weaknesses and which may easily break due to the rough environment and wave power at high sea/ocean sites, and may cost more to maintain. Thereafter, instead of a many parts hinge, a special structure of a "W" hinge-less flexible moving arm is used, which may be made of, for example, carbon fiber reinforced aqua-phobic materials that may be 200 times stronger than steel.

An exemplary embodiment of the APCR may be made entirely of graphene/carbon fibers of reinforced lignin. Lignin is not only a strong material (as it contains mainly carbon fibers) it is also degradable and recyclable and as such is a bio-material with good characteristics for the protection and sustainability of the environment.

In an exemplary embodiment there may be rails along which the container inside the belly of the whale can be moved or pulled out and in again after emptying the container's contents.

The whale tale may be mounted in an erected position of about 300 towards the incoming waves so as to absorb the maximum wave power/energy in order to generate maximum amount of electricity in two ways: by the compression and decompression of the dielectric elastomer DE materials and the rotational movement of the shaft inside the stators of the two side electric generators (dynamos). The whale tail may be held in said position by the piston which is fixed at the whale tail's surface as shown in Fig.

The lightweight dielectric elastomer can stretch and contract producing electric current and thus enough power for the APCR, because the dielectric elastomer material has very high power density (4 Watts/g.) (see Adv. Mater. http://doi.org/f3s534 (2016).

The eyes of the APCR may be two cameras for 3D vision and orientation of the whale robot. The camera's may also be equipped with a GPS sensor to direct the whale robot and signal its position at all times. Some of the content of the container with the now expanded volume of plastic digesting bacteria PDB may be released into the ocean in order to eliminate the invisible microplastic particles. PDB may be released to the open ocean as these bacteria are found in nature and are not genetically manipulated organisms. (PDB scientific name is *Ideonella sakaiensis* 201-F6, that is able to use PET as its major energy and carbon source. When grown on PET, this strain produces two enzymes capable of hydrolyzing PET and the reaction intermediate, mono(2-hydroxyethyl) terephthalic acid. Both enzymes are required toenzymatically convert PET efficiently into its two environmentally benign monomers, terephthalic acid and ethylene glycol.—See Science 11 Mar. 2016 • VOL 351 ISSUE 6278)

Further, the main body of the ACPR may be made of carbon reinforced lignin, which may be recycled material from paper industry, as lignin is a "waste material", for this industry that is thrown away or discharge in millions of tons, a material that is rich with carbon fibers and is also aqua phobic, ideal for ocean application. Furthermore, said material is also bio-degradable in water, after usage.

The dielectric elastomers DE used in the embodiments may be special polymeric materials that, when deformed by an external mechanical force, produce, when paired with the appropriate electronics, an electric current. As the shape of the elastomer changes, the effective capacitance of the device under the external force deformation also changes, and, hence, electrical power can be obtained.

The concept of dielectric elastomers was historically first discovered around 1775 by the French physicist Nicolas-Philippe Ledru. Among other achievements, Ledru discovered that a substance or a material can be deformed or altered in volume, length or width by an electric current. In particular, Ledru noticed that mercury, in a temperature column, would rise if current was applied. Then, in 1776, Italian Alessandro Volta explained the volume changes in a Leyden jar when an electric current passed through it, and was the first to give the right interpretation of this phenomenon. Later, in 1880, German physicist Wilhelm Conrad Röntgen described how a rubber substance would increase in length if current was applied to it. This was the birth of the so-called actuators and electroactive polymers of today's understanding. More recently, researchers such as Ron Pelrine and R. D. Kornbluh have contributed to the field, allowing for the efficient generation of power with high-density DE material through compression and decompression (as described in U.S. Pat. No. 9,419,545 in which mathematical equations that describe the power generation of the DE material are provided.

Electricity may be used to power two electric motors placed at the sides of the container in order to pull up the collected plastics and deposit them inside the container.

The power generation layer may be constructed of an actuator material—for example, a dielectric.

The fork-like "tongue" of the ACPR and the container behind it may be placed on rails so that it can move in and out for loading and emptying the container, and eventually for maintaining the structure.

Referring to FIG. 1A, the APCR is shown in a top view with all the details of the embodiment in which the artificial tongue, the stomach, and the tail are clearly identifiable. The whole structure of the inside of the APCR is placed on rails 101 to allow the pulling on a main container 109 which contains all the collected plastic and micro-plastic to be emptied and/or replaced. The artificial tongue of the APCR may be made of a rolling staircase with fork-like structure in place of the stairs to allow the efficient capturing and pulling of the dispersed macro-plastic objects. The micro plastic particles may be collected in a net like structure 103 made of double layer graphene oxide composite in which functioning as a filter to pick up most of the micro plastic particles dispersed in seas and oceans. The microplastics may then be conducted through a tube 121 also into the main container 109 of the APCR in which the plastic digesting bacteria PDB may be placed. There are 4 sustaining structures 104 and 108 for a fork-like artificial moving tongue of the APCR placed at a precise distance from each other on both sides of the tongue "staircase" 102 to guarantee best stability and equilibrium at a 30° angle. A series of forklike structures 105 may be attached to the staircase 102 to assist in moving plastic into the main container 109. There may be two electric motors 107 on both sides of the artificial tongue fork-like staircase 102. Exemplary FIG. 6B shows in detailed pluri arrangement of the dielectric elastomer DE cushions.

Figure 1B:
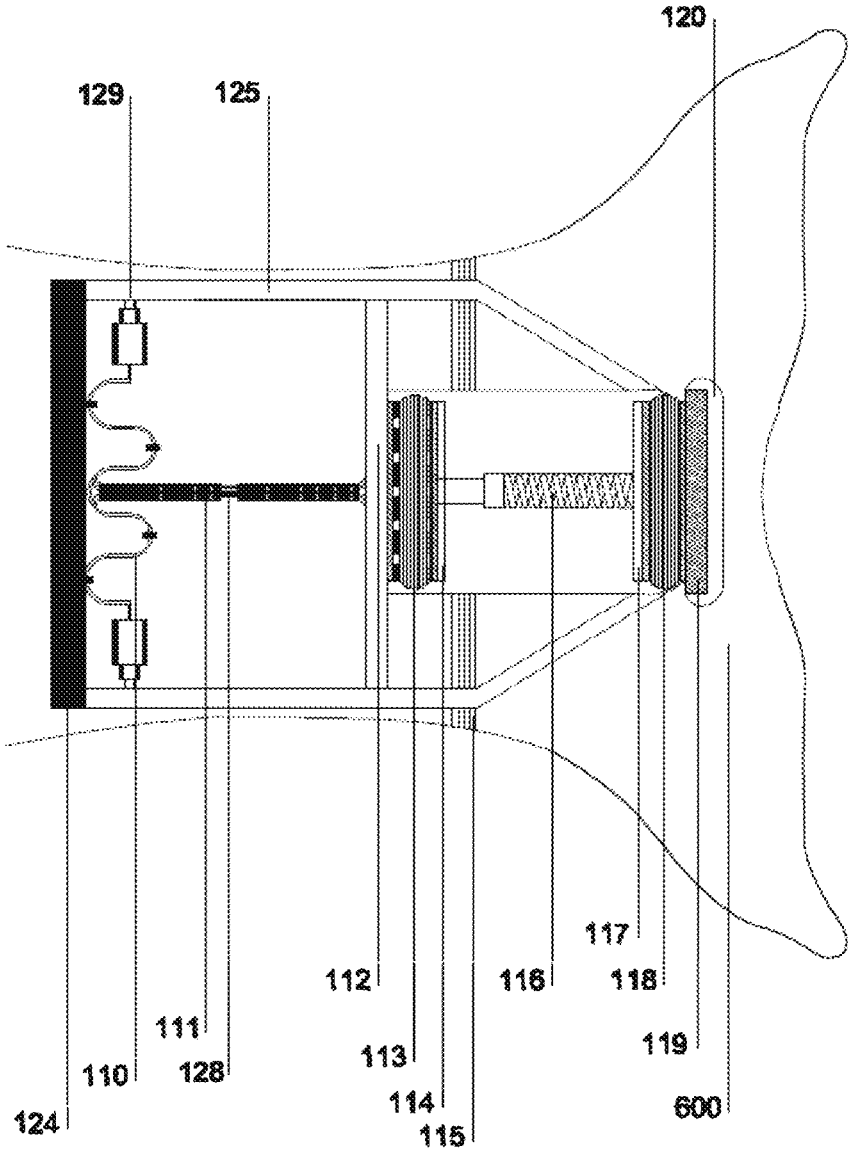
FIG. 1B shows a specific detail of the tail of the APCR.

Now referring to FIG. 1B, a tail 600 of the of the APCR which is always in a tilted position of about 30° from the surface of the sea level to guarantee maximum impact of the thrusting force of the ocean waves' power. At the center of the tail 600 there may be a depression like structure 120 in which a multilayer dielectric elastomer cushion 118 is firmly and permanently glued with water proof glue material 119 (see for example a super sea Mussels inspired glue: ACS Appl. Mater. Interfaces http://doi.org/bz8n (2017)). There is a strong carbon reinforced plate 117 place at the base of the cushion 118 to guarantee solid and stable compression on the elastic DE cushion 118. Which is part of the above piston plate 117 allowing the piston 116 to move in an oscillation type movement absorbing the wave forces and conducting it to the other DE cushion 113, and another plate 114 similar. There may be a "W" like form structure 115 allowing the tail 600 free movement with any separate parts like a fringe following the earlier concept of "all in one piece, no separate parts" principle. This structure is made of a carbon reinforce material just like the tail 600. There may be a separation disk 112 with a pore at the center allowing a rod like structure 111 made of carbon fibers reinforced material with a specific straight part 128 hand wrist tendon like material at the upper end allowing the rod to move freely without any fringe as explained above in a hand wrist like (all in one piece) allowing the shaft with two electric dynamos 129 at each end free rotational movement in order to generate additional electric power providing the necessary energy for the functioning of the APCR as a whole. There may be a wave like crank shaft 110 connecting the rod like structure 111 and the two electric dynamos 129. Thus, both the DE cushions 113 and 118 and the two dynamos shall provide the required electric power for the APCR. Finally, a fixed wall 124 may connect to the main structure of the APCR. The whole power generation system of the whale tail 600 may be placed in a hermetically sealed and waterproof outer case 125.

Figure 1C:
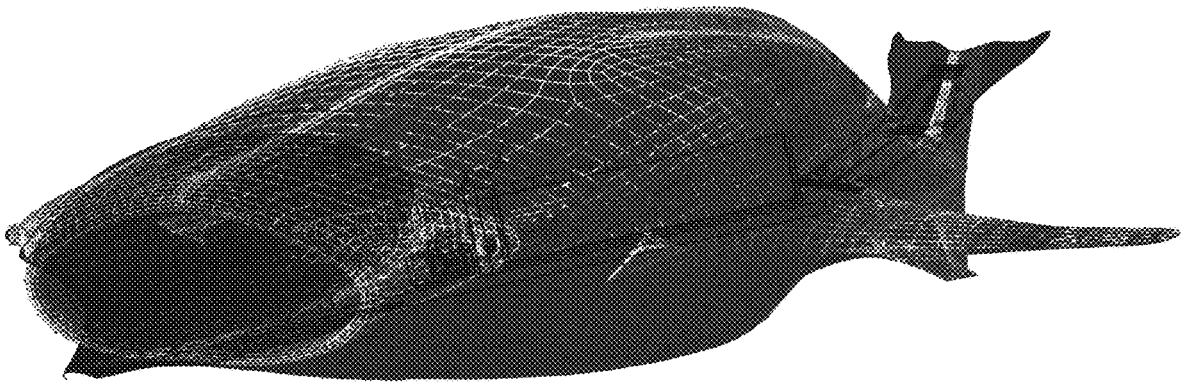
FIG. 1C shows the APCR in a 3D image with the essential parts of the same clearly represented.
Figure 2:
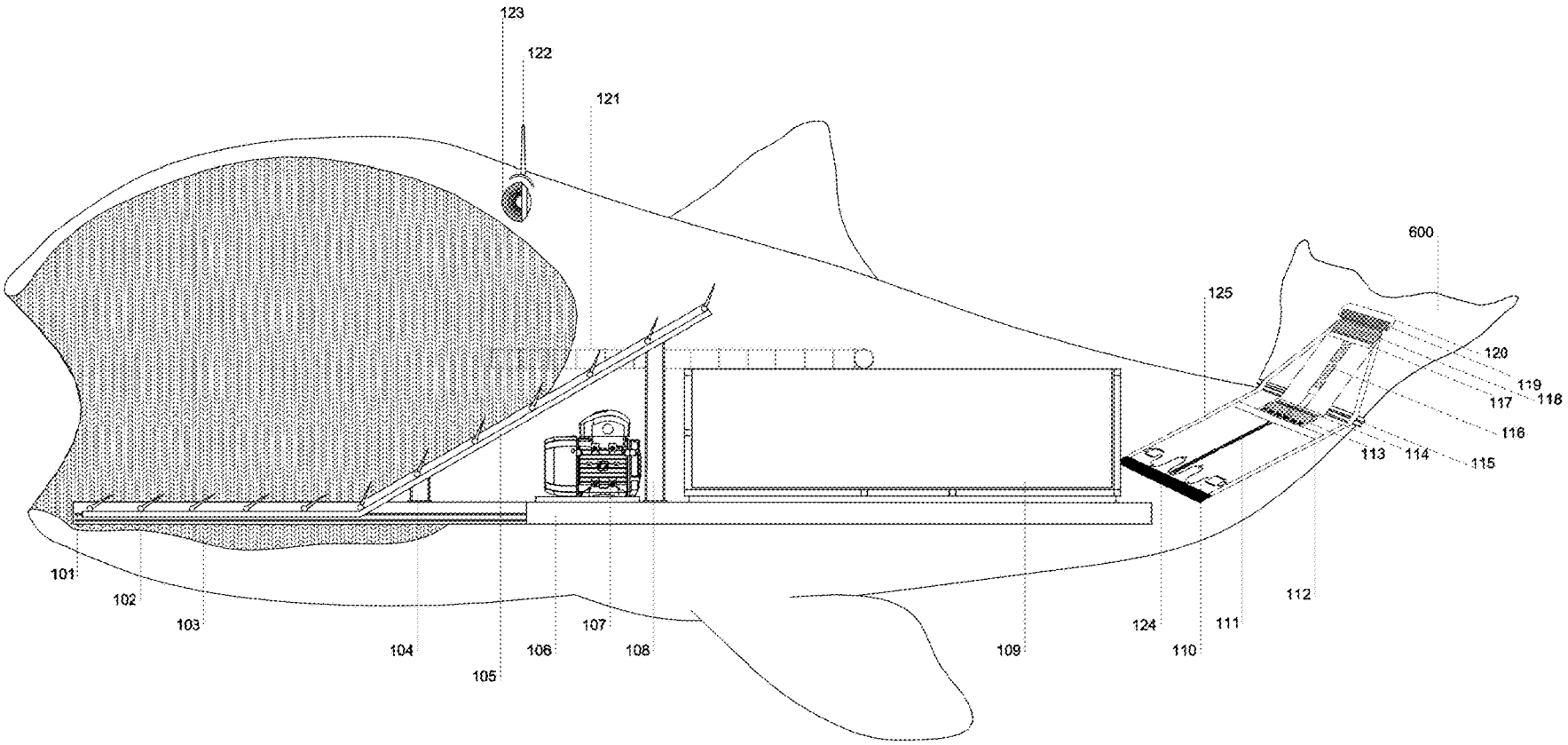
FIG. 2 shows the APCR from a side view with the details of the different parts of the same.

Referring to FIG. 1C the whole APCR is shown in 3D with all the essential parts of the embodiment herein shown inside the robotic whale shark with mouth wide open Referring to FIG. 2 in which the APCR is shown in a side view with the tail 600 in an up right position at around 30° from sea level. There may be two water proof digital cameras 123 equipped with an antenna for satellite connection 122. The two digital camera on each side of the APCR may also be equipped with a deep learning algorithm software connected with the GPs antenna for 3D vision and communication, learning, and improving the strategy for collecting plastic micro and macro particles in the seas, oceans, and sea ports.

Figure 3A:
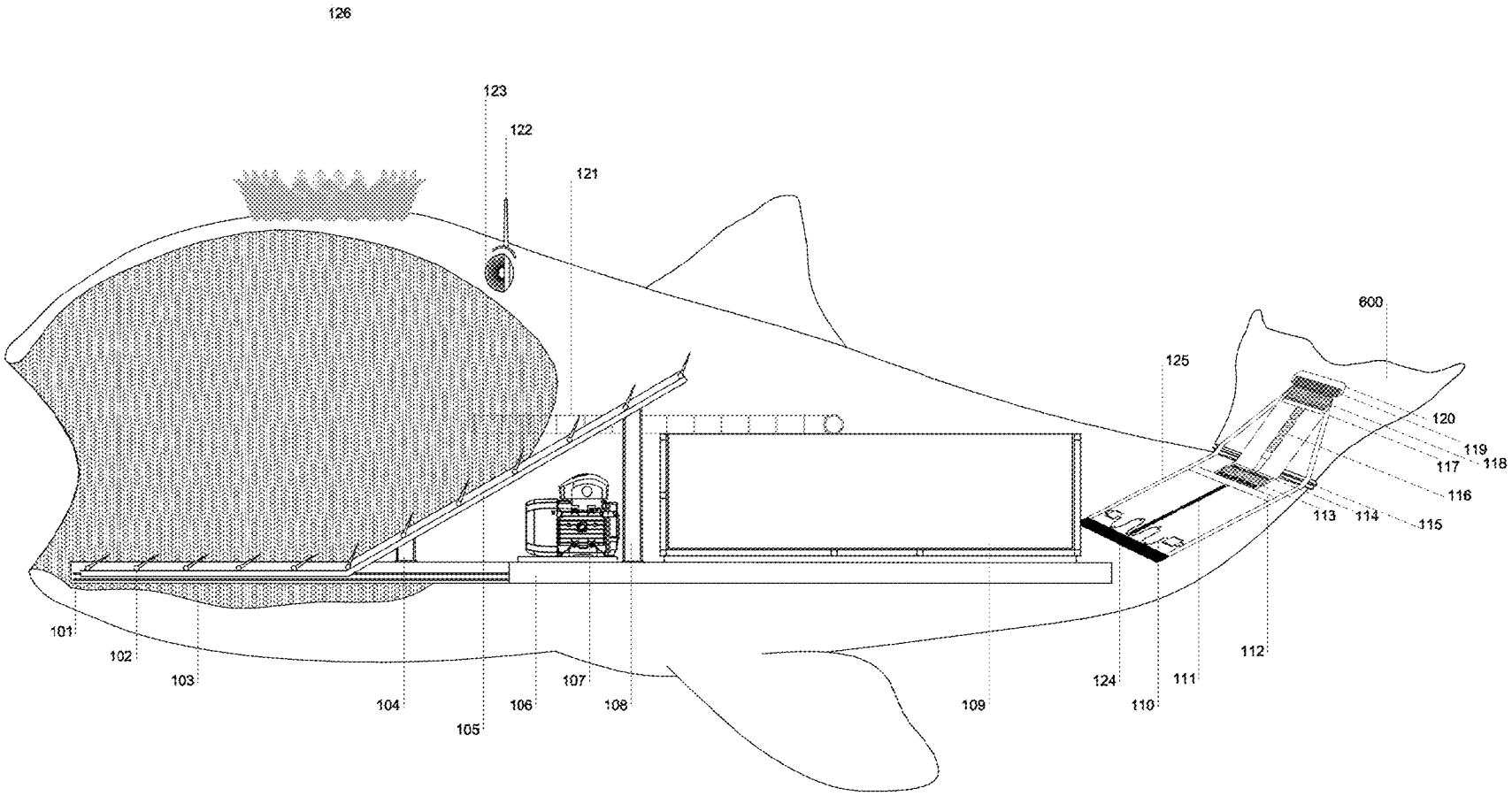
FIG. 3A shows a second the APCR with the solar lotus form disk for inside ports usage where more energy is required.

Referring to FIG. 3 the same as in above FIG. 2 but with a solar disk 126 in the form of a lotus in order to increase the electric power supply of the APCR in sea ports where the wave power is not as strong, and so additional power may be needed. The concept of the solar lotus disk has been explained in solar house U.S. Pat. No. 9,350,290 with all details including the solar container and solar pv cell at the focal point of the micro-lenses of said solar disk.

Figure 3B:
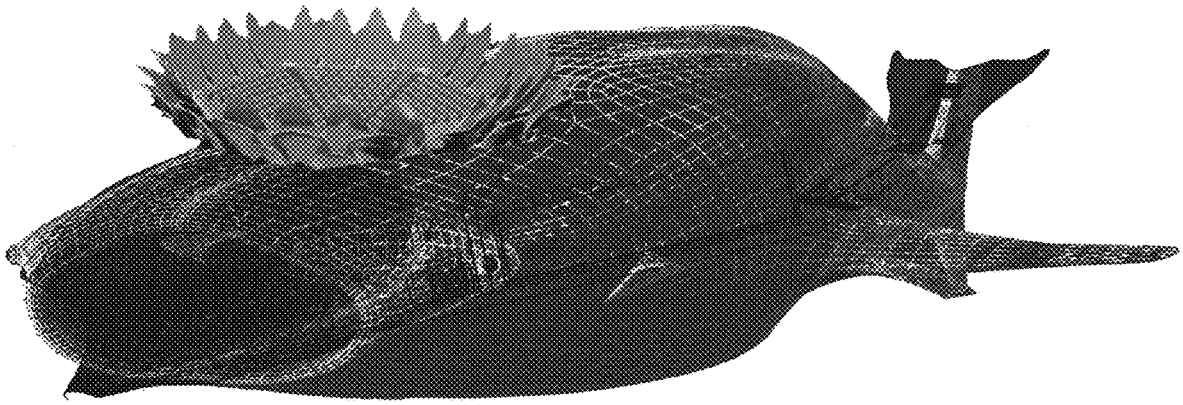

Referring to FIG. 3B shows again the APCR in 3D with the solar disk lotus for additional power supply as explain here above in FIG. 3 description.

Figure 3C:
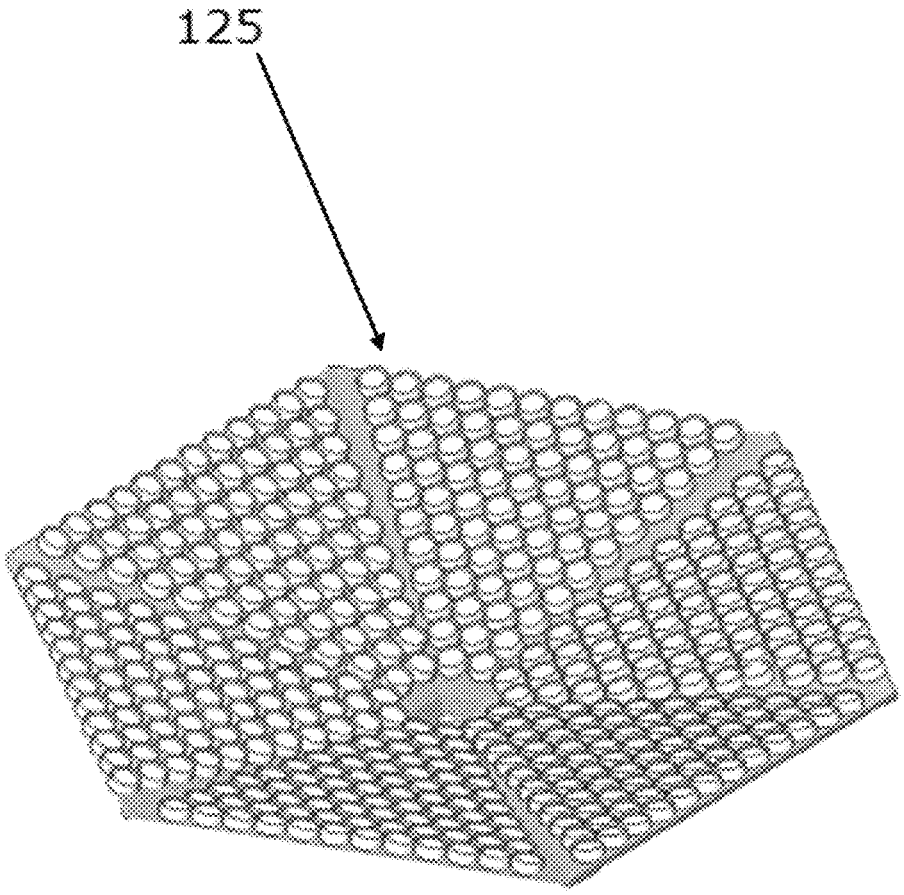
FIG. 3C shows the solar disc with its micro-lenses on small pluri-containers.

Referring to FIG. 3C shows the solar disk with its micro-lensed container as described in U.S. Pat. No. 9,350,290 "solar house" herein as 126.

Figure 4:
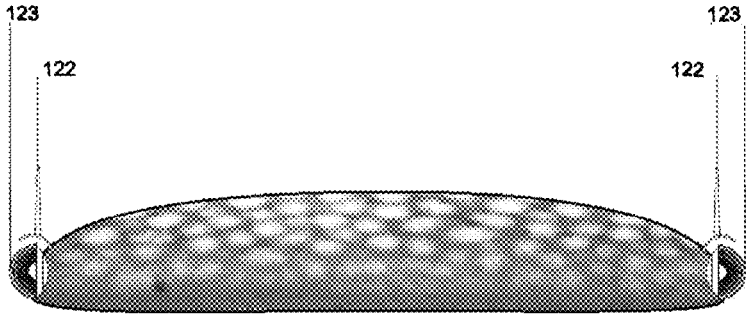
FIG. 4 shows a front view of the upper part of the APCR with the details of the two camera and antenna being separately represented.

Referring to FIG. 4, a front view the upper part of the APCR "head" is shown, with the two digital water proof cameras 123 and the two antennas 122 for GPS communication.

Figure 5:
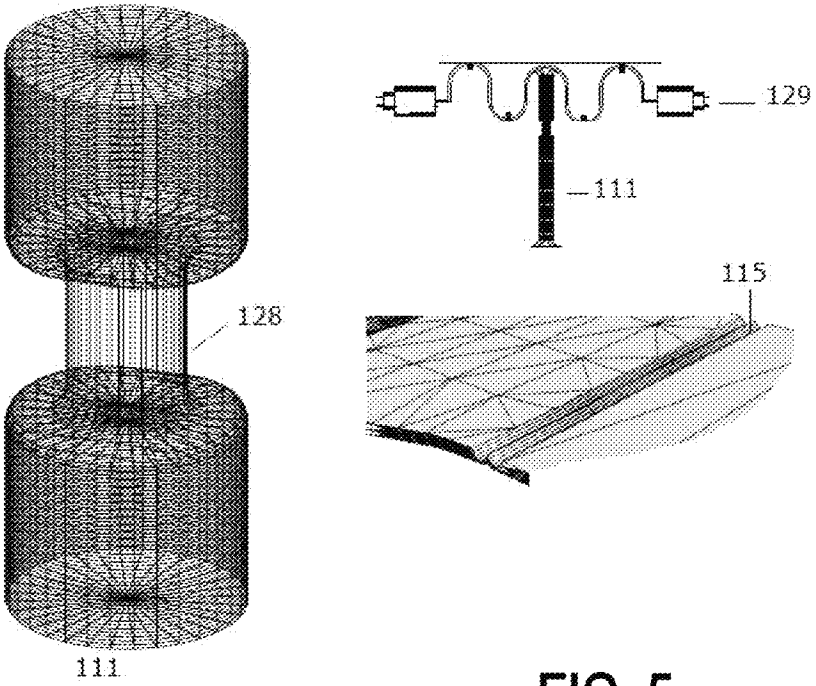
FIG. 5 shows the "No-Joints" moving parts of the APCR.

Referring to FIG. 5, in which all three applications of the "All in one piece, no separate parts" concept is shown in details for the tail 600 embodiment of the APCR. The point of connecting of the shaft with the two stators/dynamos 129 at its ends connected again to the Rod/bar 111 and the wrist-like tendon 128, while the "W" like junction (replacing many parts fringes and the like) by which the whale tail can move up and down freely absorbing the power of the ocean waves forces.

Figure 6A:
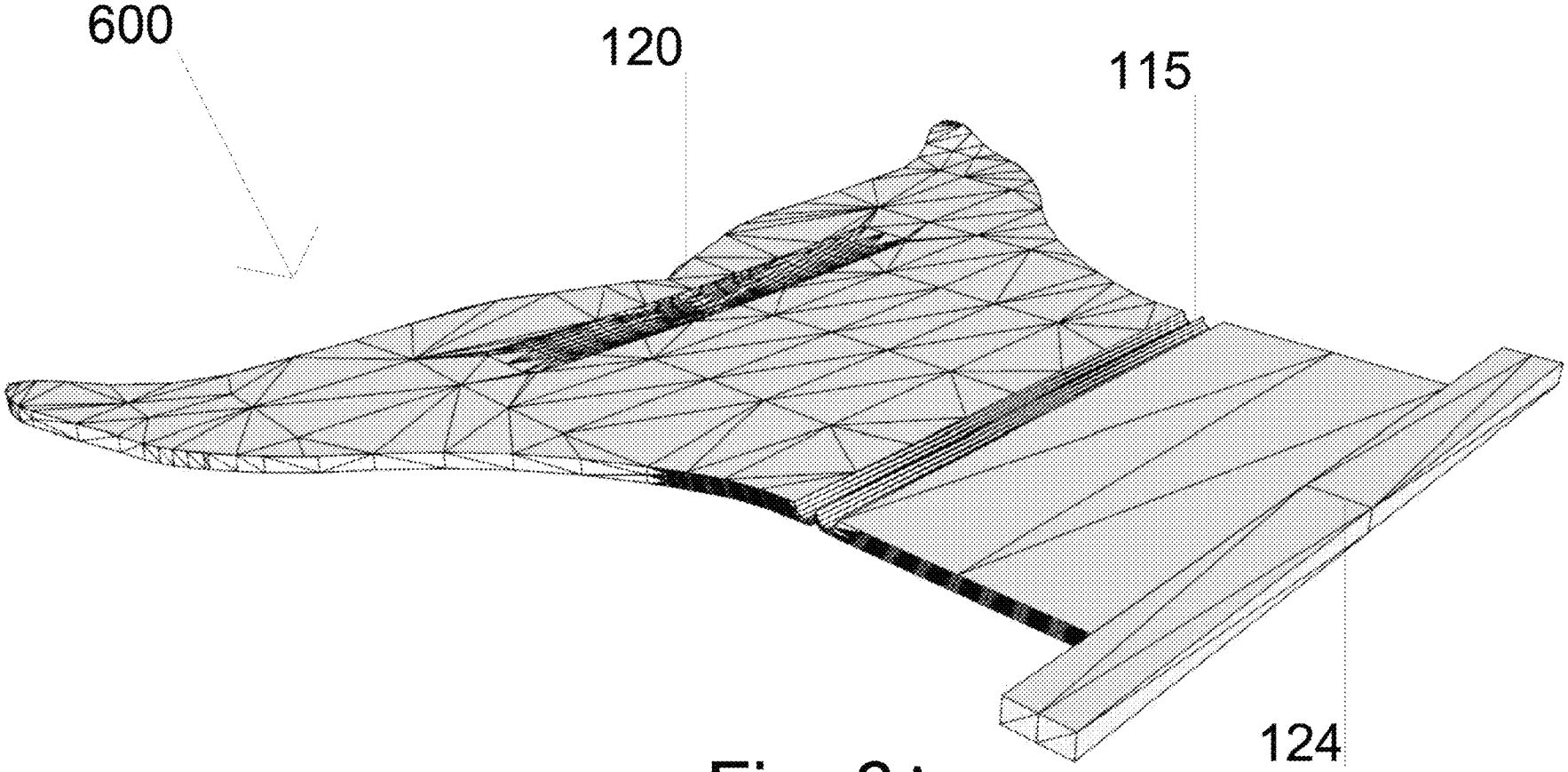
FIG. 6A shows details of the APCR tail in 3D view.
Figure 6B:
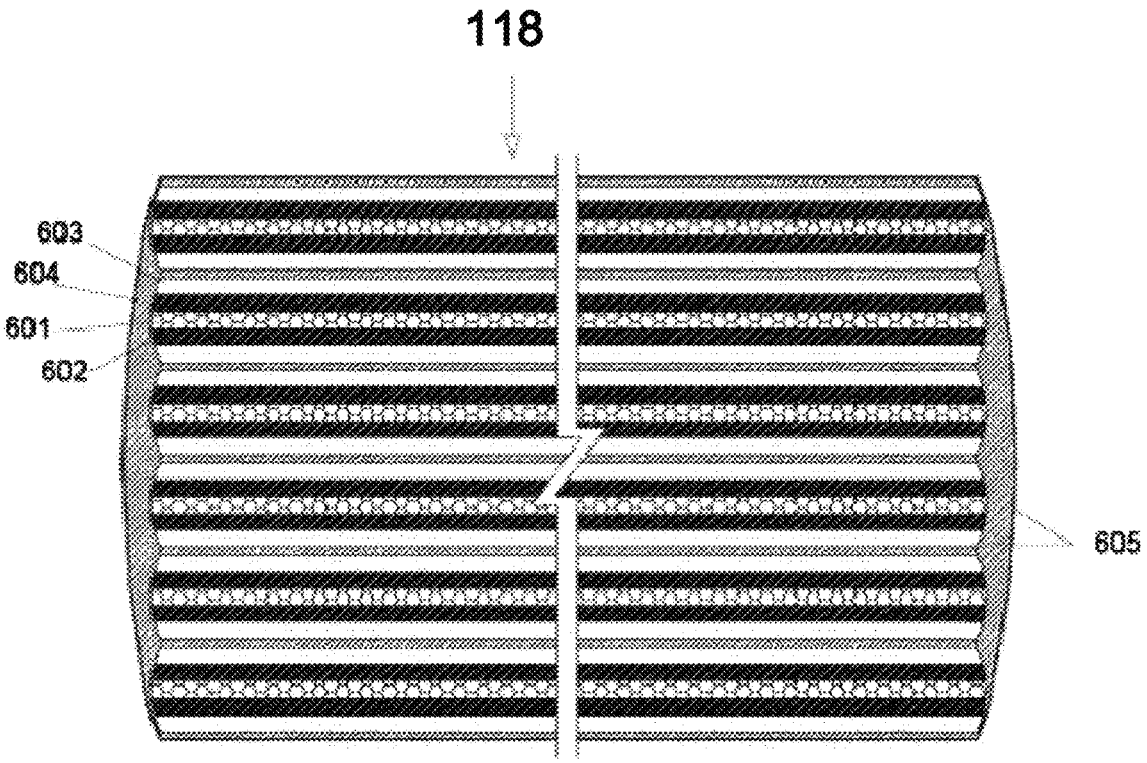
FIG. 6B shows in detailed pluri arrangement of the dielectric elastomer DE cushions.

Referring to FIG. 6A, which shows the actual APCR tail 600 without the moving parts that would then be mounted on it to generate electric power by the force of the ocean waves. Herein the depression that would hold the piston 120 and the special form "W" 115 allow for the free movement of the tail 600, without any wear and tear to parts as in fringes and the like. The simple all in one solid carbon reinforced polymer lignin structure avoids much of maintenance corrosion and reduces mounting time in production and function.

Now referring to exemplary FIG. 6B, the power generation layer 113/118 may include a multilayer of DE materials. DE may generate an electric current when compressed or decompressed by the forces of the ocean waves. Each layer may have an N-P junction 602, 604 with DE material 601 sandwiched in between. An insulator 603 may insulate the layers from each other and an elastic cushioning material 605 may provide structural support and elasticity, and may protect the power generation layers through the various stresses which may be encountered in the wave power impact on the tail 600. A power generation layers 113/118 with at least six layers is shown, but any number of layers may be used, as desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. An autonomous plastic collecting robot (APCR) device for collecting waste, comprising;

a net structure that picks up micro plastic particles dispersed in water;

a tube that transports the micro plastics collected by the net structure into a main internal container;

an artificial tongue for collecting larger plastics, the artificial tongue comprised of a rolling staircase with fork-like structures in placed of the stairs;

a plastic degrading medium contained in the main internal container; and a no-joint tail structure which acts as the primary power source for the APCR, the no-joint tail structure housing dielectric elastomer materials and a rotation shaft located between at least two electric generators.

2. The APCR device for collecting waste of claim 1, wherein the plastic degrading medium is plastic degrading bacteria or wax worms.

3. The APCR device for collecting waste of claim 1, wherein the plastic degrading medium is a plastic degrading enzyme or compound.

4. The APCR device for collecting waste of claim 1, further comprising a rail system connected to the main internal container and artificial tongue in order to enable easy loading and unloading.

5. The APCR device for collecting waste of claim 1, further comprising at least one waterproof digital camera on each side of the APCR.

6. The APCR device for collecting waste of claim 5, further comprising one or more GPS antenna, wherein each of the at least one waterproof digital cameras is equipped with an artificial intelligence algorithm that communicatively connects the at least one waterproof digital cameras to the one or more GPS antenna.

7. The APCR device for collecting waste of claim 6, further comprising a lotus solar disk connected to a top portion of the APCR.

8. The APCR device for collecting waste of claim 1, wherein the main body of the APCR is made of carbon reinforced lignin.

9. The APCR device for collecting waste of claim 1, further comprising pistons which hold the no joint tail structure in a fixed orientation, wherein the fixed orientation of the no joint tail structure is about 300 towards incoming waves.

* * * * *